US009986346B2

(12) United States Patent
Bendsen

(10) Patent No.: US 9,986,346 B2
(45) Date of Patent: May 29, 2018

(54) BINAURAL HEARING SYSTEM AND A HEARING DEVICE COMPRISING A BEAMFORMER UNIT

(71) Applicant: Oticon A/S, Smørum (DK)

(72) Inventor: Henrik Bendsen, Smørum (DK)

(73) Assignee: OTICON A/S, Smørum (DK)

( * ) Notice: Subject to any disclaimer, the term of this patent is extended or adjusted under 35 U.S.C. 154(b) by 0 days. days.

(21) Appl. No.: 15/017,942

(22) Filed: Feb. 8, 2016

(65) Prior Publication Data

US 2016/0234609 A1 Aug. 11, 2016

(30) Foreign Application Priority Data

Feb. 9, 2015 (EP) ..... 15154289

(51) Int. Cl.

| | |
|---|---|
| ***H04R 25/00*** | (2006.01) |
| *H04R 1/10* | (2006.01) |
| *H04R 1/40* | (2006.01) |
| *H04R 3/00* | (2006.01) |
| *H04R 5/033* | (2006.01) |

(52) U.S. Cl.

CPC ..... *H04R 25/552* (2013.01); *H04R 25/407* (2013.01); *H04R 1/1041* (2013.01); *H04R 1/406* (2013.01); *H04R 3/005* (2013.01); *H04R 5/033* (2013.01); *H04R 25/558* (2013.01); *H04R 2203/12* (2013.01); *H04R 2225/39* (2013.01); *H04R 2225/43* (2013.01)

(58) Field of Classification Search

CPC .... H04R 25/40; H04R 25/405; H04R 25/407; H04R 25/43; H04R 25/552; H04R 2225/39; H04R 2225/41; H04R 1/1041; H04R 1/406; H04R 3/005; H04R 5/033; H04R 25/558; H04R 2203/12; H04R 2225/43

See application file for complete search history.

(56) References Cited

U.S. PATENT DOCUMENTS

| | | | |
|---|---|---|---|
| 6,011,851 | A | 1/2000 | Connor et al. |
| 2005/0110700 | A1 | 5/2005 | Terry |

(Continued)

FOREIGN PATENT DOCUMENTS

| | | | |
|---|---|---|---|
| EP | 1107472 | A2 | 6/2001 |
| EP | 1777644 | A1 | 4/2007 |

(Continued)

*Primary Examiner* — Mark Fischer

(74) *Attorney, Agent, or Firm* — Birch, Stewart, Kolasch & Birch, LLP

(57) ABSTRACT

A binaural hearing system comprising first and second hearing devices, e.g. hearing aids, adapted to establish a communication link between them, each comprising a) first and second input units providing first and second electric input signals representing first and second sound signals from the environment of the binaural hearing system, b) a beamformer unit for generating a beamformed signal from the first and second electric input signals, and c) a control unit for controlling the beamformer unit. In a specific dual DIR mode of operation aimed at a listening situation comprising first and second target sound sources, the control units of the first and second hearing devices are configured to focus their respective beamformer units on the first and second target sound sources, respectively. The application further relates to a method of operating a binaural hearing system.

21 Claims, 6 Drawing Sheets

(56) References Cited

U.S. PATENT DOCUMENTS

| | | | | |
|---|---|---|---|---|
| 2005/0255843 | A1 | 11/2005 | Hilpisch et al. | |
| 2011/0096915 | A1* | 4/2011 | Nemer | H04M 3/568 379/158 |
| 2011/0188662 | A1* | 8/2011 | Jensen | H04R 25/552 381/23.1 |
| 2011/0222621 | A1 | 9/2011 | Christensen et al. | |
| 2012/0020485 | A1 | 1/2012 | Visser et al. | |
| 2013/0051566 | A1* | 2/2013 | Pontoppidan | H04R 25/353 381/23.1 |
| 2013/0342730 | A1* | 12/2013 | Lee | H04N 5/23293 348/231.4 |
| 2014/0294183 | A1 | 10/2014 | Lee et al. | |

FOREIGN PATENT DOCUMENTS

| | | | |
|---|---|---|---|
| EP | 2563045 | A1 | 2/2013 |
| EP | 2680615 | A1 | 1/2014 |
| EP | 2701145 | A1 | 2/2014 |
| EP | 3013070 | A2 | 4/2016 |
| WO | WO 2005/053179 | A1 | 6/2005 |
| WO | WO 2005/055654 | A1 | 6/2005 |
| WO | WO 2012/061151 | A1 | 5/2012 |

* cited by examiner

BINAURAL HEARING SYSTEM AND A HEARING DEVICE COMPRISING A BEAMFORMER UNIT

TECHNICAL FIELD

The present application relates to hearing devices, in particular to a binaural hearing system comprising first and second hearing devices. The disclosure relates specifically to a binaural hearing system comprising first and second hearing devices adapted for being mounted at or in left and right ears of a user, each hearing device comprising a beamformer unit for generating a beamformed signal from first and second electric input signals. The application furthermore relates to a method of operating a binaural hearing system.

Embodiments of the disclosure may e.g. be useful in applications such as binaural hearing aid systems, ear phone or ear protection systems.

BACKGROUND

When two persons are talking, it requires a certain amount of 'processing power' of a hearing impaired third person to distinguish between the voices of the two persons and to separate the two sound sources, if they overlap in time. It is especially demanding, if it is not possible for the hearing impaired person to observe the mouths of the talking persons (to practice lip reading). Similar problems may arise in noisy environments where (e.g. normally hearing) persons wear ear-protection devices that (in a specific mode of operation) allow the reception of selected parts of the surrounding sound field.

In a typical hearing instrument comprising a directional microphone system (beamformer), a standard directional mode of operation (DIR mode) is provided to focus a characteristic of the microphone system on the sound sources (to provide maximum gain (minimum attenuation) in a direction of the target sound source(s), cf. illustration on FIG. 1A. FIG. 1A shows a standard reaction of a (two-microphone) hearing instrument to focus listening in a given direction, i.e. to listen to two persons talking, where both instruments of a binaural hearing system are focused on both talkers (at the same time) meaning they will receive almost the same sound mix at each ear.

SUMMARY

The present application relates to a binaural hearing system comprising left and right hearing devices, each hearing device comprising a beamformer unit. An alternative directional mode, termed Dual-DIR mode in the present disclosure, is proposed. The Dual-DIR mode is preferably entered in a 'two-persons-talking scenario'. Such acoustic situation may e.g. be identified manually, e.g. by a user, e.g. via a user interface, or automatically, e.g. using advanced algorithms and information interchange between the two hearing devices (and/or an auxiliary device) of the binaural hearing system. Based on information from a user, the first and/or second hearing device(s) and/or an auxiliary device, the Dual-DIR mode is entered, wherein the beamformer units of the first and second hearing devices focus their beams to cover only ONE talker each (e.g. respective first and second talkers). This is schematically illustrated in FIG. 1B Having substantially only sound from one talker in each ear drastically decreases the brainwork needed to separate the two person's voices. In an embodiment, where a communication link between the two hearing devices can be established (e.g. to allow streaming of sound between the first and second hearing devices), the respective voices can be forwarded from the hearing device where it has been picked up to the other hearing device of the binaural hearing system (optionally processed to be separated in time, to include directional cues (e.g. by applying e.g. pre-determined) head-related transfer functions (HRTFs). Likewise, performance can also be further enhanced by using psychoacoustic algorithms to make the voices appear as if the persons were placed farther away from each other than they are in real-life. This method might be more 'listen-friendly' than just providing one talker in each ear.

An object of the present application is provide an alternative scheme for separating two target sound sources in a mixed sound environment.

Objects of the application are achieved by the invention described in the accompanying claims and as described in the following.

A Binaural Hearing System:

In an aspect of the present application, an object of the application is achieved by a binaural hearing system comprising first and second hearing devices, e.g. hearing aids, adapted for being mounted at or in left and right ears or fully or partially implanted in the head of a user, each hearing device comprising first and second input units providing first and second electric input signals representing first and second sound signals from the environment of the binaural hearing system,

- a beamformer unit for generating a beamformed signal from the first and second electric input signals, and
- a control unit for controlling the beamformer unit, wherein—in a specific dual DIR mode of operation aimed at a listening situation comprising first and second target sound sources—the control unit of the first hearing device is configured to focus the beamformer unit of the first hearing device on the first target sound source, and the control unit of the second hearing device is configured to focus the beamformer unit of the second hearing device on the second target sound source.

This has the advantage of providing an improved separation of sound inputs from two adjacent sound sources.

In an embodiment, each of the first and second hearing devices of the binaural hearing system comprises an output unit for generating or receiving and presenting stimuli perceivable to a user as sound.

In an embodiment, the binaural hearing system is configured to present a signal originating from the first sound source via the output unit of the first hearing device, and to present a signal originating from the second sound source via the output unit of the second hearing device.

In an embodiment, the binaural hearing system is adapted to establish a communication link between the first and second hearing devices. In an embodiment, each of the first and second hearing devices comprises antenna and transceiver circuitry for establishing a wireless communication link between the two hearing devices (e.g. via a third (auxiliary) device).

In an embodiment, the binaural hearing system comprises a user interface allowing a user to control functionality of the binaural hearing system (or to present data, e.g. processed to the user, e.g. graphically).

In an embodiment, the binaural hearing system comprises a user interface allowing a user to control functionality of the beamformer unit. In an embodiment, the binaural hearing system is configured to allow a selection of a mode of operation, e.g. the 'dual DIR' mode of operation, of the binaural hearing system via the user interface. In an embodiment, the binaural hearing system is configured to operate in at least two modes, the dual DIR mode and a normal mode of operation (different from the dual DIR mode).

In an embodiment, the binaural hearing system comprises an environment classification unit for classifying the current acoustic environment. In an embodiment, the binaural hearing system (e.g. an auxiliary device) comprises an environment classification unit for classifying the current acoustic environment (around the binaural hearing system). In an embodiment, each of the first and second hearing devices comprises an environment classification unit for classifying the current acoustic environment (around the respective hearing device). In an embodiment, the binaural hearing system is configured to exchange information about the current acoustic environment between devices of the binaural hearing system, and optionally external devices. In an embodiment, at least one (preferably both) of the first and second hearing devices comprises antenna and transceiver circuitry for establishing a wireless communication link to an auxiliary device.

In an embodiment, the binaural hearing system comprises a source localization unit for localizing one or more sound sources in the acoustic environment. In an embodiment, each of the first and second hearing devices comprises a source localization unit for localizing one or more sound sources in the acoustic environment (around the respective hearing device). In an embodiment, the source localization unit is configured to localize one or more sound sources $S_s$ in the acoustic environment relative to the location of the binaural hearing system (or relative to a particular hearing device of the binaural hearing system, e.g. based on first and second electric input signals of a particular hearing device). In an embodiment, the source localization unit is configured to provide respective localization parameters $LP_s$ of the one or more sound sources ($s=1, 2, \ldots, N_s$, where $N_s$ is the number of sound sources, e.g. $N_s=2$). In an embodiment, a sound source localization unit is fully or partially implemented in an auxiliary device, e.g. a SmartPhone.

In an embodiment, at least one of the first and second hearing devices is/are configured to receive from an auxiliary device a location information related to a direction to and/or location of the first and/or second target sound source relative to the at least one of the first and second hearing devices.

In an embodiment, the user interface is implemented in the auxiliary device, e.g. a remote control device, a cellular telephone (e.g. a SmartPhone), or other communication device. In an embodiment, the binaural hearing system comprises the auxiliary device. In an embodiment, the auxiliary device, e.g. a SmartPhone, is configured to run an APP allowing to control the functionality of the binaural hearing system and/or to provide a user interface. In an embodiment, the first and/or second hearing device(s) comprises an appropriate wireless interface to the auxiliary device (e.g. a SmartPhone), e.g. based on Bluetooth or some other standardized or proprietary scheme.

In an embodiment, at least one of the first and second hearing devices is/are configured to receive system location information from the user interface.

In an embodiment, the first and second hearing devices each comprise a source localization unit for localizing one or more sound sources in the acoustic environment. In an embodiment, the first and second hearing devices are configured to identify said first and second (different) sound sources (each e.g. comprising speech).

In an embodiment, the first and second hearing devices are configured to transmit location information (e.g. direction or angle information regarding a dominant sound source (e.g. comprising speech)) to the opposite hearing device (e.g. for comparison and possible mode change). In an embodiment, the binaural hearing system (e.g. each hearing device) is configured to enter the dual DIR mode of operation, where the first and second hearing devices focus their respective beamformer units on the first and second sound sources, respectively. In an embodiment, the first and second hearing devices are configured to enter the dual DIR mode of operation based on said location information from the first and second hearing devices.

In an embodiment, the first and second hearing devices are configured to transmit location information to an auxiliary device (e.g. for display at a user interface).

In an embodiment, each hearing device comprises more than two input units, e.g. a third input unit in addition to said first and second input units. In an embodiment, each of the first and second input units comprises a microphone. In an embodiment, each hearing device comprises a third input unit configured to receive an electric input signal from another device, e.g. from the other hearing device of the binaural hearing system, or from an auxiliary device. In an embodiment, each of the first and second input units comprises a time to time-frequency conversion unit for providing the first and second electric input signals in a time-frequency representation. In an embodiment, each of the input units of the first and second hearing devices comprises a time to time-frequency conversion unit for providing the respective electric input signals in a time-frequency representation.

In an embodiment, the binaural hearing system is configured to provide that a signal originating from the first sound source is transmitted to the second hearing device and/or a signal originating from the second sound source is transmitted to the first hearing device via the communication link. In an embodiment, where a communication link between the first and second hearing devices can be established (e.g. to allow the streaming of sound between the first and second hearing devices), the signals originating from the first and second sound sources can be forwarded from the hearing device where it has been picked up to the other hearing device of the binaural hearing system (optionally processed, e.g. to be separated in time).

In an embodiment, the binaural hearing system is configured to present a signal originating from the first sound source, which is transmitted to the second hearing device, to the user via the output unit of the second hearing device. In an embodiment, the binaural hearing system is configured to present a signal originating from the second sound source, which is transmitted to the first hearing device, to the user via the output unit of the first hearing device.

In an embodiment, the binaural hearing system is configured to present a signal originating from the first sound source, which is transmitted to the second hearing device, to the user via the output unit of the second hearing device with a configurable delay. In an embodiment, the binaural hearing system is configured to present a signal originating from the second sound source, which is transmitted to the first hearing device, to the user via the output unit of the first hearing device with a configurable delay. In an embodiment, the delay is configured to avoid overlap in time between the signals originating from the first and second sound sources (when presented to the user).

In an embodiment, the binaural hearing system is configured to include directional cues to a signal originating from the first or second sound source when transmitted to and presented to the user via output units of the second and first hearing devices, respectively. In an embodiment, the binaural hearing system is adapted to include directional cues in the signals originating from the first and second sound source by applying relevant head-related transfer functions (HRTFs) to the signals (the HRTFs being e.g. pre-determined and stored in a memory of the binaural hearing system, e.g. in each of the first and second hearing devices).

In an embodiment, the binaural hearing system is configured to apply a psycho-acoustic algorithm to a signal originating from the first or second sound source to make the presented signals appear to the user as if the first and second target sound sources were placed farther away from or closer to each other than they actually are.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, the wireless link established by a transmitter and antenna and transceiver circuitry of the hearing device can be of any type. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the wireless link is based on a standardized or proprietary technology. In an embodiment, the wireless link is based on Bluetooth technology (e.g. Bluetooth Low-Energy technology).

In an embodiment, the hearing device has a maximum outer dimension of the order of 0.05 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise).

In an embodiment, the hearing device comprises an own voice detector for detecting whether a given input sound (e.g. a voice) originates from the voice of the user of the system.

In an embodiment, the hearing device comprises an acoustic (and/or mechanical) feedback suppression system.

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

A Hearing Device:

In an aspect of the present application, an object of the application is achieved by a hearing device, e.g. a hearing aid, adapted for being mounted at or in left and right ears or fully or partially implanted in the head of a user, the hearing device comprising

- an input unit providing an electric input signal representing a sound signal from the environment of the hearing device,
- a beamformer unit for generating a beamformed signal from the electric input signal, and
- a control unit adapted for—in a specific dual DIR mode of operation aimed at a listening situation comprising first and second target sound sources—creating directional information identifying a direction from the hearing device to at least one of the first and second target sound sources; and
- transceiver circuitry adapted for exchanging directional information about the direction to the first and/or second target sound sources with another device, e.g. another hearing device;
- wherein the control unit is further adapted to compare directional information created in the hearing device with directional information received from another device via the transceiver circuitry and to select one of the first and second target sound sources based thereon, and to control the beamformer unit to focus in a direction towards the selected one of the first and second target sound sources.

In an embodiment, the hearing device is or comprises a hearing aid. In an embodiment, the other device is or comprises another hearing aid.

It is intended that some or all of the structural features of the hearing system described above, in the 'detailed description of embodiments' or in the claims can be combined with embodiments of the hearing device, and vice versa.

Embodiments of the method have the same advantages as the corresponding systems.

Use:

In an aspect, use of a binaural hearing system as described above, in the 'detailed description of embodiments' and in the claims, is moreover provided. In an embodiment, use is provided in a system comprising one or more hearing instruments, headsets, ear phones, active ear protection systems, etc.

A method:

In an aspect, a method of operating a binaural hearing system, the binaural hearing system comprising first and second hearing devices adapted for being mounted at or in left and right ears or fully or partially implanted in the head of a user, the method comprising

- providing first and second electric input signals representing first and second sound signals from the environment of the binaural hearing system,
- generating a beamformed signal from the first and second electric input signals, and
- controlling the beamformed signal is furthermore provided by the present application.

The method further comprises that—in a specific dual DIR mode of operation aimed at a listening situation comprising first and second target sound sources—the beamformed signal of the first hearing device is configured to focus on the first target sound source, and the beamformed signal of the second hearing device is configured to focus on the second target sound source.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises the step of manually (e.g. via a user interface) or automatically providing a direction to and/or a location of the first and/or second target sound sources.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising one or two hearing devices and being adapted to cooperatively provide audible signals to both of the user's ears. Listening systems or binaural listening systems may further comprise 'auxiliary devices', which communicate with the hearing devices and affect and/or benefit from the function of the hearing devices. Auxiliary devices may be e.g. remote controls, audio gateway devices, mobile phones, public-address systems, car audio systems or music players. Hearing devices, listening systems or binaural listening systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1A:
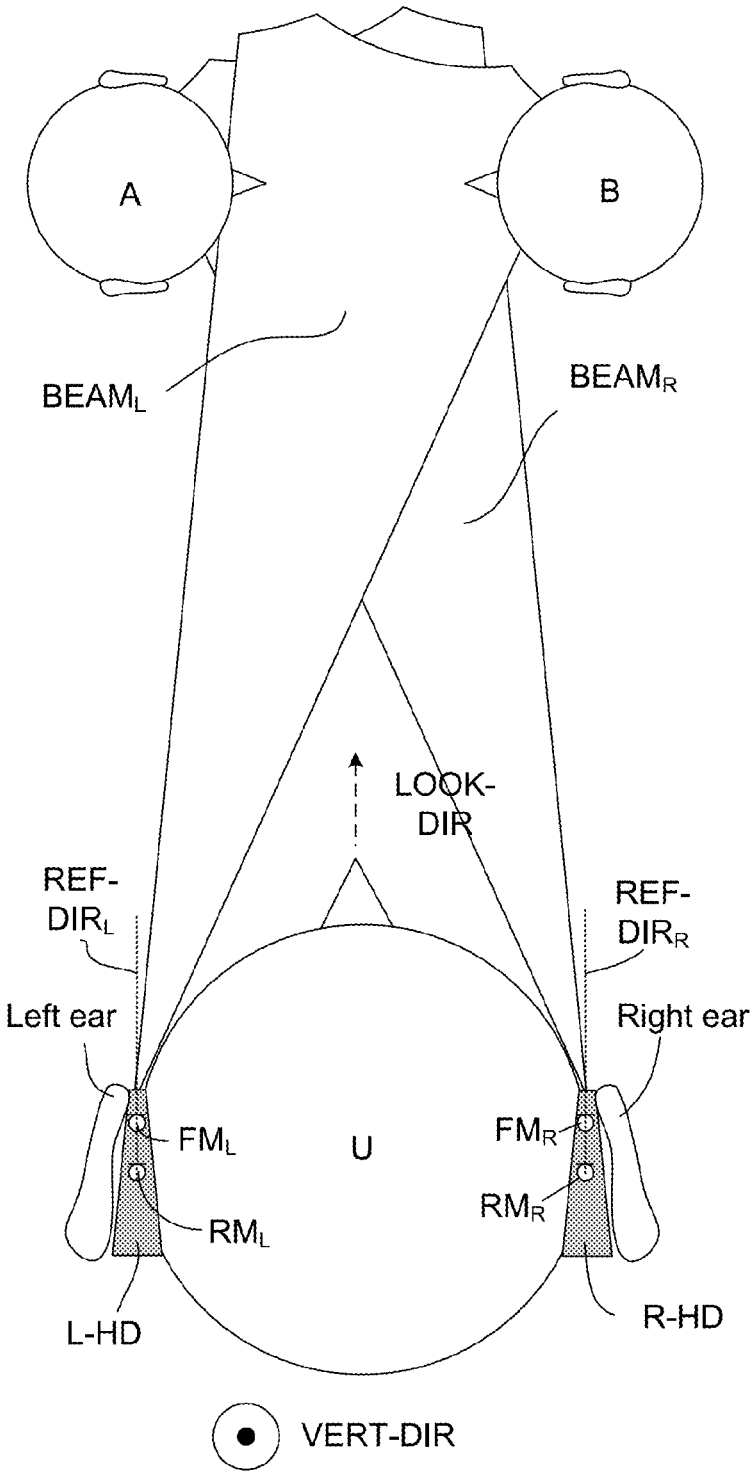
FIGS. 1A and 1B show two different modes of operation of beamformer units of first and second hearing devices of a binaural hearing system, FIG. 1A illustrating a normal mode of operation, and FIG. 1B illustrating a Dual DIR mode of operation according to the present disclosure.
Figure 1B:
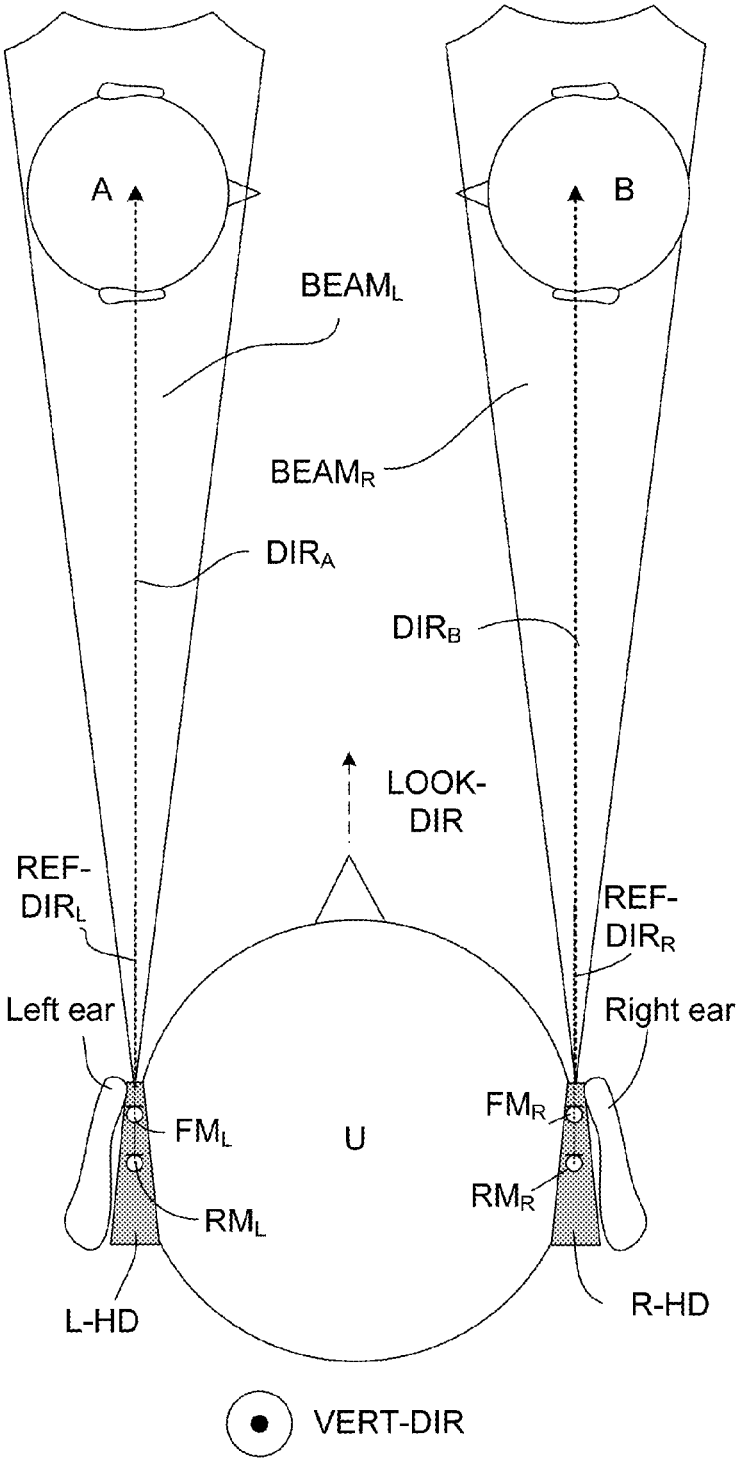

FIGS. 1A and 1B show two different modes of operation of beamformer units of first and second hearing devices of a binaural hearing system, FIG. 1A illustrating a normal mode of operation, and FIG. 1B illustrating a Dual DIR mode of operation according to the present disclosure. The acoustic situation schematically illustrated by FIGS. 1A and 1B is the same, a user (U) listening to a conversation between two persons (A and B) in front of the user (here shown in a direction of attention, a look direction (LOOK-DIR), of the user (U)). The user is equipped with left and right hearing devices (L-HD and R-HD) located at the left (Left ear) and right ears (Right ear), respectively, of the user. The left and right hearing devices each comprises at least two input units for providing first and second electric input signals representing first and second sound signals from the environment of the binaural hearing system, and a beamformer unit for generating a beamformed signal from the first and second electric input signals. In the embodiments of FIG. 1, the first and second input units are implemented by front ($FM_L$, $FM_R$) and rear ($RM_L$, $RM_R$) microphones, in the left and right hearing devices, respectively, 'front' and 'rear' being defined relative to the look direction of the user (and assuming that the hearing devices are correctly mounted). located in a front and rear. The front ($FM_L$, $FM_R$) and rear ($RM_L$, $RM_R$) microphones of the left and right hearing devices, respectively, constitute respective microphone systems, which together with respective configurable beamformer units allow each hearing device to maximize the sensitivity of the microphone system (cf. schematic beams $BEAM_L$ and $BEAM_R$, respectively) in a specific direction relative to the hearing device in question (REF-$DIR_L$, REF-$DIR_R$, respectively, e.g. equal to the look direction (LOOK-DIR) of the user, assuming that the hearing devices are correctly mounted). The view of FIGS. 1A and 1B is intended to represent a horizontal cross-sectional view perpendicular to the surface on which the two persons A and B and the user U are standing (or otherwise located), as indicated by the symbol denoted VERT-DIR intended to indicate a vertical direction with respect to said surface (e.g. of the earth).

FIG. 1A schematically shows a typical configuration of the beamformed signals of a binaural hearing system comprising left and right (two-microphone) hearing devices (L-HD and R-HD) focusing listening on a given target, here aiming to listen to two persons talking. In other words, both instruments of a binaural hearing system are focused on the two talkers (at the same time) meaning they will receive almost the same mixed sound signal at each ear (hearing device).

FIG. 1B schematically illustrates the Dual-DIR mode according to the present disclosure. In the Dual DIR mode (aimed at listening to two persons in conversation), the beamformer units of the left and right hearing devices (L-HD and R-HD) each are configured to focus their beams to cover only ONE talker each (e.g. respective first and second talkers; here the left hearing device (L-HD) focuses on person A and the right hearing device (R-HD) focuses on person B). The focused beams $BEAM_L$ and $BEAM_R$ of the left and right hearing devices are defined by directions $DIR_A$ and $DIR_B$ from the left and right hearing devices to persons A and B respectively. In an embodiment, the respective 'clean' signals from person A and B are presented to the user (U) as received by the respective hearing device (L-HD and R-HD). This has the advantage of (to a certain extent) separate the two sound sources (A and B) compared to the mixture of the two signals picked up by the binaural hearing system of FIG. 1A. Other uses of the respective received signals at the left and right hearing devices may advantageously be made, typically involving some sort of processing of the 'clean' received signals (e.g. delay, frequency shaping, and/or addition of directional cues), as outlined in connection with the embodiments described in the following. In an exemplary embodiment, the binaural hearing system is configured to apply a psycho-acoustic algorithm to a signal originating from the first or second sound source to make the presented signals appear to the user as if the first and second target sound sources were placed farther away from or closer to each other than they actually are.

It should be noted that the focused beams $BEAM_L$ and $BEAM_R$ of the left and right hearing devices are schematically shown in FIGS. 1A and 1B as clearly defined angular sectors (in the presented cross-section). In practice, the 'beams' will be less clearly defined and not necessarily exhibit a linearly limited cross-section of a cone. Likewise, the beams are illustrated as if they stop at the location of the persons A and B. This need not be the case either. The beams may cover a larger area beyond the location of the persons A and B. Preferably, however, the beams $BEAM_L$ and $BEAM_R$ of the left and right hearing devices are configured to 'just include' the persons A and B (i.e. to reflect a direction ($DIR_A$, $DIR_B$) and distance from the left and right hearing devices to the persons A and B, respectively).

Figure 2:
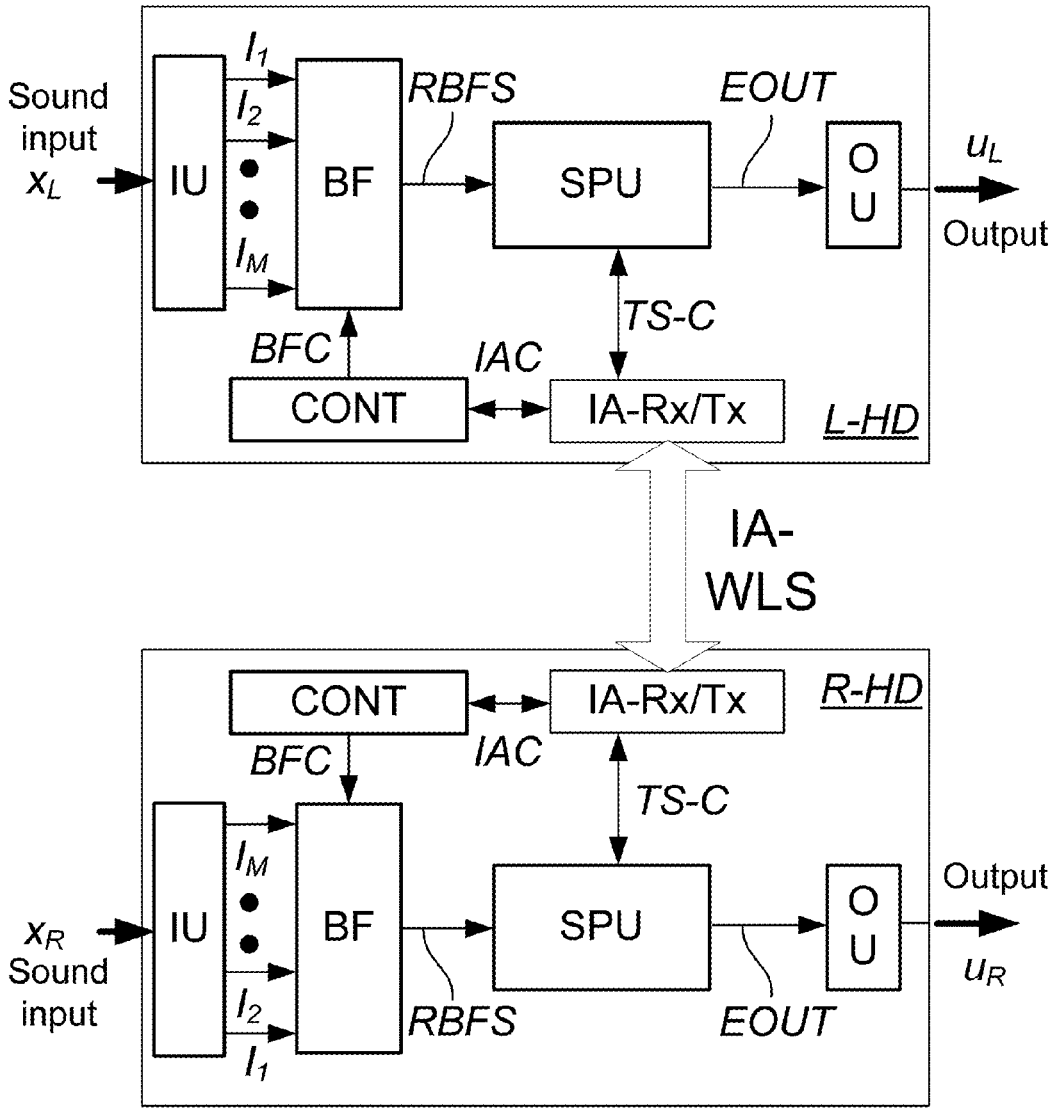
FIG. 2 shows an embodiment of a binaural hearing system comprising first and second hearing devices according to the present disclosure.

FIG. 2 shows an embodiment of a binaural hearing system comprising first and second hearing devices according to the present disclosure. The first and second hearing devices (also termed left and right hearing devices, and denoted L-HD and R-HD in the drawings) are adapted for being mounted at or in left and right ears or fully or partially implanted in the head of a user. Each of the left and right hearing devices comprises a multitude of input units (in common denoted IU in FIG. 2) each providing an electric input signal $I_m$, (m=1, 2, . . . , M) representing respective sound signals from the environment of the binaural hearing system (represented in FIG. 2 by Sound input $x_L$ at the left and Sound input $x_R$ at the right hearing device respectively). Each of the left and right hearing devices further comprises a beamformer unit (BF) for generating a beamformed signal RBFS from the multitude of electric input signals ($I_1$, $I_2$, . . . , $I_M$). The left and right hearing devices further comprises respective control unit (CONT) for controlling the beamformer units in its various modes of operation (cf. signal BFC), including in the specific dual DIR mode of operation aimed at a listening situation comprising first and second target sound sources (cf. FIG. 1B). The binaural hearing system is configured to provide that—in the dual DIR mode of operation—the control unit (CONT) of the left hearing device (L-HD) is configured to focus the beamformer unit (BF) of the left hearing device on the first target sound source (person A in FIG. 1B), and the control unit of the right hearing device (R-HD) is configured to focus the beamformer unit (BF) of the right hearing device on the second target sound source (person B in FIG. 1B). In the embodiment of FIG. 2, each of the left and right hearing devices comprises a signal processing unit (SPU) for processing the beamformed signal RBFS and provide a processed signal EOUT to an output unit (OU) for generating or receiving and presenting stimuli perceivable to a user as sound based thereon (the output stimuli being denoted Output $u_L$ and Output $u_R$ in the left and right hearing devices, respectively). In an embodiment, the binaural hearing system is configured to present a signal originating from the first sound source (person A in FIG. 1B) via the output unit (OU) of the left hearing device, and to present a signal originating from the second sound source (person B in FIG. 1B) via the output unit (OU) of the right hearing device.

A forward path from Sound input to Output is defined by the operational connection of the input units (IU), the beamformer unit (BF), the signal processing unit (SPU) and the output unit (OU) and any functional components located there between. In an embodiment, the number M of input units is two, such as three or four.

In the embodiment of FIG. 2, the binaural hearing system is adapted to establish a communication link between the left and right hearing devices (L-HD, R-HD). Each of the left and right hearing devices comprises antenna and transceiver circuitry (IA-Rx/Tx) for establishing a wireless communication link (IA-WLS) between the two hearing devices (e.g. directly, as indicated, or via a third (auxiliary) device). The inter-aural link can e.g. be used to exchange respective audio signals (e.g. the beamformed signals (RBFS)) between the left and right hearing devices. In an embodiment, the binaural hearing system is configured to transmit a signal originating from the first sound source (person A in FIG. 1B), picked up by the left hearing device, to the right hearing device via the communication link (IA-WLS). Likewise, the binaural hearing system may be configured to transmit a signal originating from the second sound source (person B in FIG. 1B), picked up by the right hearing device, to the left hearing device via the communication link (IA-WLS). The transmitted audio signals are received and extracted in the respective transceiver units (IA-Tx/Rx) and preferably forwarded to respective signal processing units (SPU), cf. signal TS-C. Control or information signals may likewise be exchanged between the first and second hearing devices via the inter-aural communication link (IA-WLS), and forwarded to appropriate functional units, e.g. to the control unit for controlling the beamformer unit (BF) (cf. signal IAC) and/or to the processing units (SPU) for controlling the processing of signals of the forward path (cf. signal TS-C).

Further, the binaural hearing system may be configured to present a signal originating from the first sound source (person A in FIG. 1B), picked up by the left hearing device, and which is transmitted to the second hearing device, to the user via the output unit (OU) of the second hearing device. Likewise, the binaural hearing system may be configured to present a signal originating from the second sound source (person B in FIG. 1B), picked up by the right hearing device, and which is transmitted to the first hearing device, to the user via the output unit (OU) of the first hearing device. In an embodiment, the audio signals received from the opposite hearing device are processed in advance of being presented to the user. In an embodiment, an audio signal (the 'opposite audio signal') received in a first hearing device from an (opposite) second hearing device is mixed with an audio signal (the 'local audio signal') picked up by the first hearing device itself. In an embodiment, the processing (e.g. mixing) of audio signals received from the opposite hearing device comprise the application of a configurable delay to the opposite and/or to the local audio signals to avoid or minimize substantial overlap in time of speech content in the respective signals. In an embodiment, the binaural hearing system is configured to include directional cues to a signal originating from the first or second sound source when transmitted to and presented to the user via output units of the opposite hearing devices (i.e. the second and first hearing devices, respectively). Thereby, a spatial impression is imposed on the transmitted signals, to emulate the effect of time and level differences normally inherent in acoustic signals received by the two ears of a user from a given acoustic source (due to the geometry and properties of the human head and body).

The input unit (IU) may comprise one or more input transducers, e.g. microphone units (such as $M_1$, $M_2$ in FIGS. 3A and 3B), preferably having an omni-directional gain characteristic, and/or one or more receivers of an audio signal, e.g. a wireless receiver. The output unit (OU) may comprise an output transducer, e.g. a loudspeaker (such as SP in FIGS. 3A and 3B) for converting an electric signal to an acoustic signal, and/or a transmitter (e.g. a wireless transmitter) for forwarding the resulting signal to another device for further analysis and/or presentation. The output unit (OU) may alternatively (or additionally) comprise a vibrator of a bone anchored hearing aid and/or a multi-electrode stimulation arrangement of a cochlear implant type hearing aid for providing a mechanical vibration of bony tissue and electrical stimulation of the cochlear nerve, respectively.

In an embodiment, the input unit IU comprises a microphone array comprising a multitude of microphones (e.g. more than two). The beamformer filter (BF) is configured for making frequency-dependent directional filtering of the electric input signals ($I_1$, $I_2$, . . . , $I_M$). The output of the beamformer filter (BF) is a resulting beamformed output signal (RBFS), e.g. being optimized to comprise a relatively large (target) signal (S) component and a relatively small noise (N) component (e.g. to have a relatively large gain in a direction of the target signal and to comprise a minimum of noise). In an embodiment, wherein the hearing device comprises a hearing aid, the signal processing unit (SPU) is configured to apply a level and/or frequency dependent gain to the input signal (here RBFS), e.g. to adjust the input signal to the impaired hearing ability of the user. In an embodiment, the beamformer unit comprises a combined beamformer-noise reduction system. Such systems may be implemented in many different ways as is customary in the art, e.g. as a Minimum Variance Distortionless Response (MVDR) beam former and a single-channel post-filter (see e.g. EP2701145A1).

Apart from the mentioned features, the hearing devices of FIG. 2 may further comprise other functionality, such as a feedback estimation and/or cancellation system (for reducing or cancelling acoustic or mechanical feedback leaked via an 'external' feedback path from output to input transducer of the hearing device). Typically, the signal processing is performed on digital signals. In such case the hearing device comprises appropriate analogue-to-digital (AD) and possibly digital-to-analogue (DA) converters (e.g. forming part of the input and possibly output units (e.g. transducers)). Alternatively, the signal processing (or a part thereof) is performed in the analogue domain.

Figure 3A:
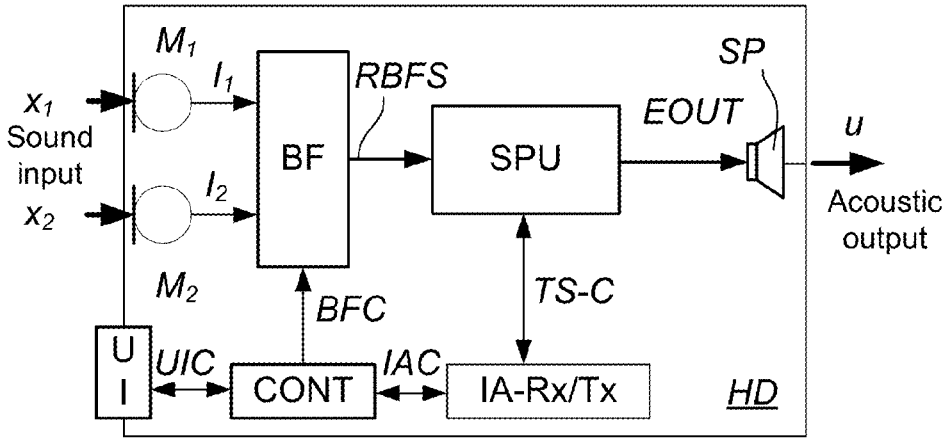
FIGS. 3A and 3B show two embodiments of a hearing device adapted to form part of a binaural hearing system according to the present disclosure, FIGS. 3A and 3B illustrating embodiments where signal processing of the forward path is performed in the time domain and in the time-frequency domain, respectively.
Figure 3B:
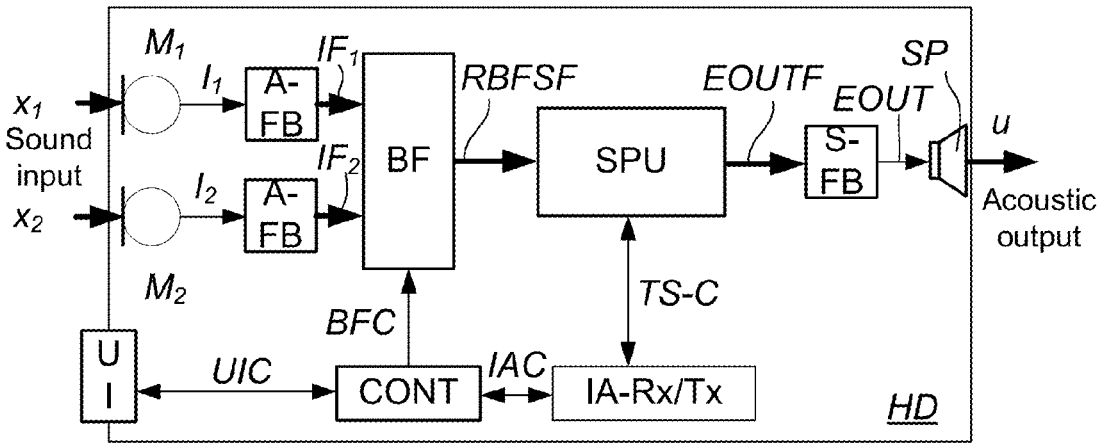

FIGS. 3A and 3B show two embodiments of a hearing device adapted to form part of a binaural hearing system according to the present disclosure. A binaural hearing system can e.g. be provided by two hearing devices as shown in FIG. 3A or FIG. 3B located at or in left and right ears of a user.

FIGS. 3A and 3B both shows a hearing device (HD) including the functional elements and operational connections as shown in FIG. 2 (represented by any of the left and right hearing devices (L-HD, R-HD)) and described above. A difference is that the embodiments of FIGS. 3A and 3B additionally comprise a user interface (UI) allowing a user to control functionality of the hearing device, e.g. the beamformer unit (BF). A further difference is that the input unit(s) IU are implemented as two microphones $M_1$ and $M_2$ providing input signals $I_1$ and $I_2$, respectively (i.e. M=2), which are fed to the beamformer unit (BF), each microphone receiving respective Sound input $x_1$ and $x_2$. Further, the output unit (OU) is in the embodiments of FIGS. 3A and 3B implemented as a loudspeaker unit (SP) converting the processed signal EOUT to an Acoustic output signal, u. The user interface (IU) is configured to allow a user to control functionality (e.g. a mode of operation, e.g. of the beamformer unit) of the binaural hearing system (and/or to present data, e.g. processed data, to the user, e.g. graphically), cf. signal U/C. In an embodiment, the user interface (UI) comprises an activation element on the hearing device (HD). Preferably, the binaural hearing system is configured to allow a selection of a mode of operation, e.g. the 'dual DIR' or a 'normal' mode of operation, of the binaural hearing system via the user interface.

The embodiment of FIG. 3A illustrates an embodiment of a hearing device (HD), where signal processing of the forward path (e.g. in the beamformer unit (BF) and in the signal processing unit (SPU)) is performed in the time domain.

The embodiment of FIG. 3B illustrates an embodiment of a hearing device (HD), where signal processing of the forward path is performed in the time-frequency domain, e.g. in a number of frequency bands. This is implemented by including an analysis filter bank (A-FB) in each of the microphone paths (between the microphone units $M_1$ and $M_2$ and the beamformer unit (BF)) and a synthesis filter bank (S-FB) between the signal processing unit (SPU) and the loudspeaker unit (SP). Signals of the forward path, including in the beamformer unit (BF) and in the signal processing unit (SPU), is performed in the time-frequency domain (in a number of frequency bands, each represented by time variant signals at frequencies of a particular band), as indicated by the postponed 'F' in the signal names ($IF_i$ (i=1, 2), RBFSF and EOUTF). In an embodiment, the transceiver unit (IA-Rx/Tx) comprises a time to time frequency conversion unit (e.g. an analysis filter bank) to convert a signal received from an opposite hearing device into the time-frequency domain (so that it can be processed, and possibly mixed with the beamformed signal RBFSF of the forward path, in the signal processing unit (SPU), cf. signal TS-C).

Figure 4A:
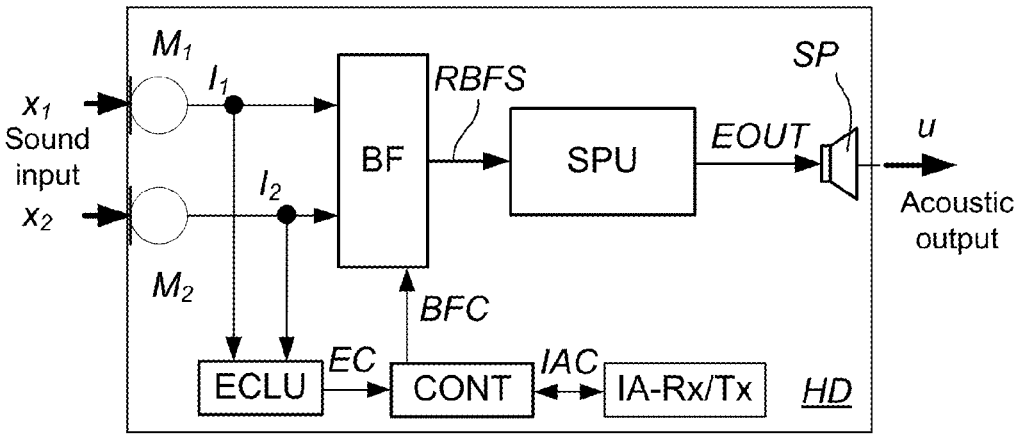
FIGS. 4A and 4B show two further embodiments of a hearing device adapted to form part of a binaural hearing system according to the present disclosure, FIGS. 4A and 4B illustrating embodiments comprising an environment classification unit for influencing a mode of operation of the hearing device in question.
Figure 4B:
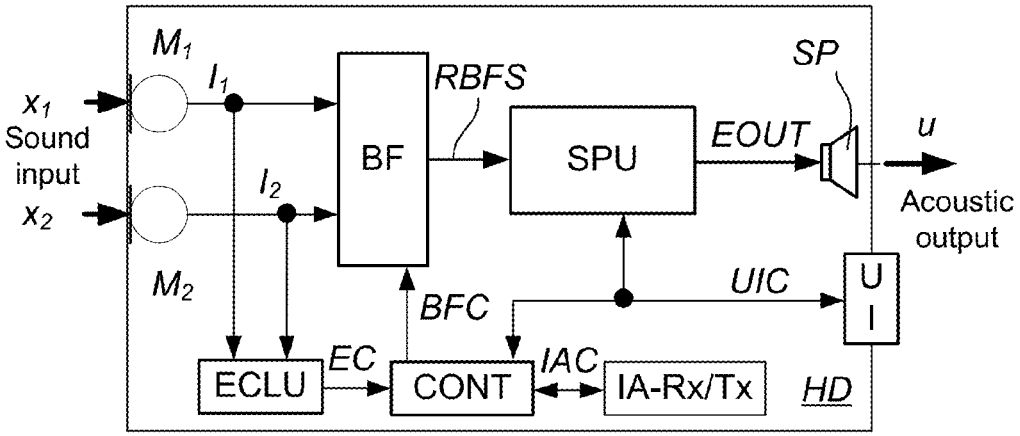

FIGS. 4A and 4B shows two further embodiments of a hearing device (HD) adapted to form part of a binaural hearing system according to the present disclosure, FIGS. 4A and 4B illustrating embodiments comprising an environment classification unit (ECLU) for influencing a mode of operation of the hearing device in question. A binaural hearing system can e.g. be provided by two hearing devices as shown in FIG. 4A or FIG. 4B located at or in left and right ears of a user.

FIG. 4A shows an embodiment of a hearing device (HD) comprising a forward path comprising first and second microphones ($M_1$, $M_2$), a beamformer unit (BF), a signal processing unit (SPU) and a loudspeaker (SP) as in FIG. 3A. It further comprises a control unit (CONT) and a transceiver unit (IA-Rx/Tx) for establishing a wireless link to another hearing device as also shown in FIG. 3A. Instead of the user interface (UI) of the embodiment of FIG. 3A, the embodiment of FIG. 4A comprises an environment classification unit (ECLU) for influencing a mode of operation of the hearing device. The environment classification unit (ECLU) is operationally connected to the first and second microphones ($M_1$, $M_2$) (receives electric input signals ($I_1$, $I_2$)) and provides mode control signal EC indicative of a type of acoustic environment of the hearing device in question. The mode control signal EC is fed to the control unit (CONT) and used to influence the mode of operation of the beamformer unit (BF), e.g. to identify a dual DIR mode, and configured the beamformer unit to focus on a specific one of the target signals (as illustrated in FIG. 1B).

FIG. 4B shows an embodiment of a hearing device (HD) as illustrated in FIG. 4A but additionally comprising a user interface (UI). The user interface (UI) is adapted to allow a user to influence the mode of operation of the hearing device, e.g. in combination with the environment classification unit (ECLU). In an embodiment, a binaural hearing system comprising left and right hearing devices, each as shown in FIG. 4B, is configured to provide that user inputs via the user interface regarding a mode of operation of the beamformer unit (BF) override possible indications from the environment classification unit (ECLU). In an embodiment, the binaural hearing system, e.g. one or both of the left and right hearing devices (L-HD, R-HD) comprises a source localization unit for localizing one or more sound sources in the acoustic environment. An output from such localization unit is preferably used to influence a mode of operation of the binaural hearing system (e.g. the beamformer unit), e.g. whether or not a dual DIR mode can preferably be entered. In an embodiment, information about the current acoustic environment from the environment classification unit (ECLU) and/or a localization unit are presented to a user via the user interface (UI), and may be used by the user to identify an appropriate mode of operation, which may be imposed on the system via the user interface.

Preferably, the user interface comprises a graphical interface, e.g. a (possibly touch sensitive) display. In an embodiment, a single user interface for the binaural hearing system, e.g. embodied in a separate auxiliary device, e.g. a remote control, e.g. implemented as an APP of a communication device, e.g. a SmartPhone, is provided. An embodiment of such a system is illustrated in FIG. 5.

Figure 5:
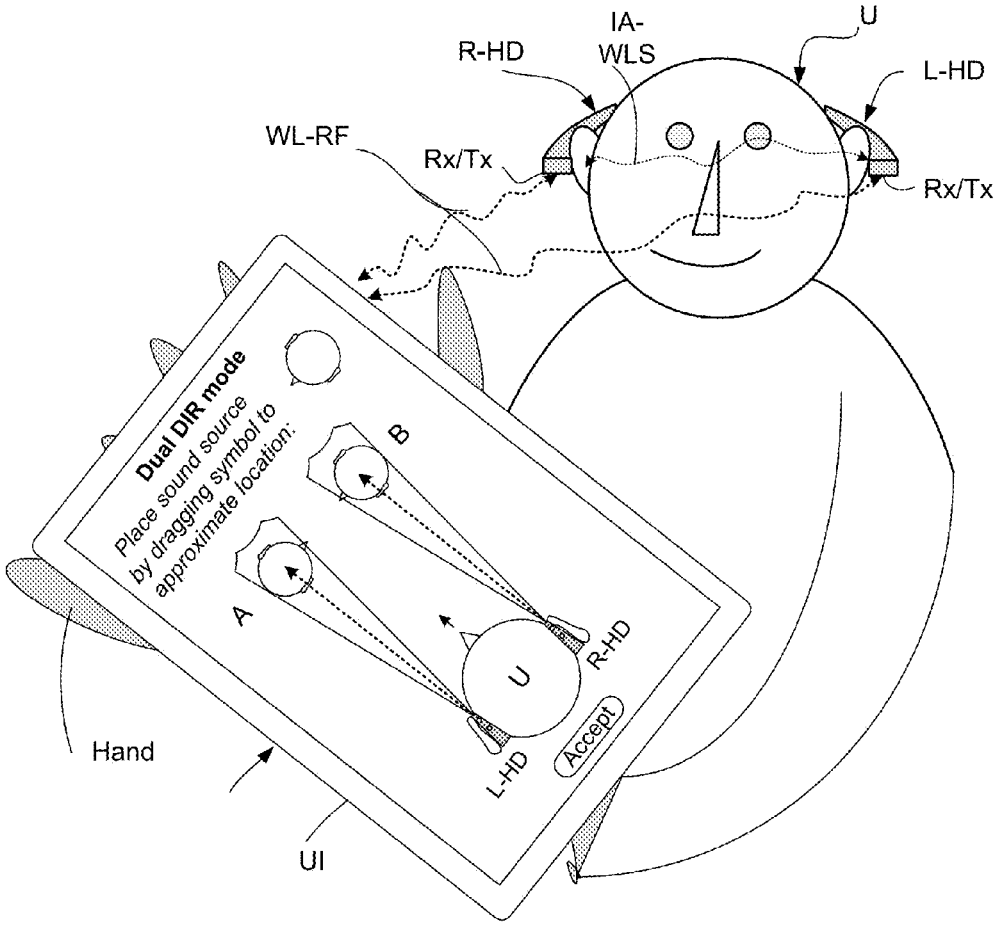
FIG. 5 shows an embodiment of a binaural hearing system comprising first and second hearing devices and an auxiliary device in communication with the hearing devices, the auxiliary device comprising a user interface for influencing a mode of operation of the binaural hearing system.

FIG. 5 shows an embodiment of a binaural hearing system comprising first e.g. (left) and second hearing (e.g. right) devices (L-HD, R-HD) and an auxiliary device (AD) in communication with the hearing devices. The auxiliary device (AD) comprises a user interface (UI) for influencing a mode of operation of the binaural hearing system, e.g. each of the left and right hearing devices (L-HD, R-HD), in particular the beamformer units (BF) of the hearing devices.

Further, at least one of the left and right hearing devices, preferably both, of the binaural hearing system is configured to receive from the auxiliary device (AD) a location information related to a direction to and/or location of the first and/or second target sound source relative to the left and/or right hearing devices (L-HD, R-HD), cf. e.g. FIG. 1B.

The left and right hearing assistance devices (L-HD, R-HD) are e.g. implemented as described in connection with FIG. 2-4. In the embodiment of FIG. 5, the binaural hearing assistance system comprises an auxiliary device (AD) in the form of or comprising a cellphone, e.g. a SmartPhone. The left and right hearing assistance devices (L-HD, R-HD) and the auxiliary device (AD) each comprise relevant antenna and transceiver circuitry (Rx/Tx) for establishing wireless communication links between the hearing assistance devices (link IA-WLS) as well as between at least one of or each of the hearing assistance devices and the auxiliary device (link WL-RF). In an embodiment, the intramural link IA-WLS is based on near-field communication (e.g. on inductive coupling), but may alternatively be based on radiated fields (e.g. according to the Bluetooth standard, and/or be based on audio transmission utilizing the Bluetooth Low Energy standard). In an embodiment, the link WL-RF between the auxiliary device and the hearing assistance devices is based on radiated fields (e.g. according to the Bluetooth standard, and/or based on audio transmission utilizing the Bluetooth Low Energy standard), but may alternatively be based on near-field communication (e.g. on inductive coupling). The bandwidth of the links (IA-WLS, WL-RF) is preferably adapted to allow sound source signals (or at least parts thereof, e.g. selected frequency bands and/or time segments) and/or localization parameters identifying a current location of a sound source to be transferred between the devices. In an embodiment, processing of the system (e.g. sound source localization) and/or the function of a remote control is fully or partially implemented in the auxiliary device AD (e.g. a SmartPhone). In an embodiment, the user interface UI is implemented by the SmartPhone possibly running an APP allowing to control the functionality of the audio processing device via the SmartPhone, e.g. utilizing a display of the SmartPhone to implement a graphical interface (e.g. combined with text entry options).

As illustrated in FIG. 5 by a screen of the 'Dual DIR mode'-APP, a current location of the two target sound sources relative to the user (U) can be defined via the user interface (UI) of the SmartPhone (which is convenient for viewing and interaction via a touch sensitive display, when the Smartphone is held in a hand (Hand) of the user (U)). The current sound sources A, B (cf. FIG. 1B) displayed by the user interface may e.g. be located relative to the user by dragging the source symbols (head) to its approximate location. In the illustrated example, the target sound sources are located as in FIG. 1B. The binaural hearing assistance system (including the auxiliary device) is configured to determine and transmit localization parameters $LP_A$ $LP_B$ corresponding to the location of the two target sound sources, as proposed by the user via the user interface, to the left and right hearing assistance devices, respectively, of the binaural hearing assistance system. Additionally, the user is allowed to manipulate the sound field by placing one or more sound sources at another position than its/their physical (or otherwise proposed) location to thereby influence the received signals.

Various aspects of inductive communication links (IA-WLS) are e.g. discussed in EP 1 107 472 A2, EP 1 777 644 A1, US 2005/0110700 A1, and US2011222621A1. WO 2005/055654 and WO 2005/053179 describe various aspects of a hearing aid comprising an induction coil for inductive communication with other units. A protocol for use in an inductive communication link is e.g. described in US 2005/0255843 A1.

In an embodiment, the RF-communication link (WL-RF) is based on classic Bluetooth as specified by the Bluetooth Special Interest Group (SIG) (cf. e.g. https://www.bluetooth.org). In an embodiment, the (second) RF-communication link is based other standard or proprietary protocols (e.g. a modified version of Bluetooth, e.g. Bluetooth Low Energy modified to comprise an audio layer).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims. Accordingly, the scope should be judged in terms of the claims that follow.

The invention claimed is:

1. A binaural hearing system comprising first and second hearing devices adapted for being mounted at or in left and right ears or fully or partially implanted in the head of a user, each hearing device comprising first and second input units providing first and second electric input signals representing first and second sound signals from the environment of the binaural hearing system, a beamformer unit for generating a beamformed signal from the first and second electric input signals, a control unit for controlling the beamformer unit, and an output unit for generating or receiving and presenting stimuli perceivable to the user as sound, wherein, in a specific directional mode of operation for listening to different sound sources, the control unit of the first hearing device is configured to obtain location information of a first target sound source, and to use the location information of the first target sound source to focus the beamformer unit of the first hearing device on the first target sound source, the control unit of the second hearing device is configured to obtain location information of a second target sound source, which is different from the first target sound source, and to use the location information of the second target sound source to focus the beamformer unit of the second hearing device on the second target sound source while the beamformer unit of the first hearing device is focused on the first target sound source, and the binaural hearing system is configured to present a signal originating from the first target sound source via the output unit of the first hearing device, and to present a signal originating from the second target sound source via the output unit of the second hearing device.

2. A binaural hearing system according to claim 1 wherein each of the first and second hearing devices of the binaural hearing system comprises an output unit for generating or receiving and presenting stimuli perceivable to a user as sound.

3. A binaural hearing system according to claim 1 adapted to establish a communication link between the first and second hearing devices.

4. A binaural hearing system according to claim 3 wherein a signal originating from the first sound source is transmitted to the second hearing device and/or a signal originating from the second sound source is transmitted to the first hearing device via the communication link.

5. A binaural hearing system according to claim 4 configured to present a signal originating from the first sound source, which is transmitted to the second hearing device, to the user via the output unit of the second hearing device.

6. A binaural hearing system according to claim 5 configured to present a signal originating from the first sound source, which is transmitted to the second hearing device, to the user via the output unit of the second hearing device with a configurable delay.

7. A binaural hearing system according to claim 4 configured to include directional cues to a signal originating from the first or second sound source when transmitted to and presented to the user via output units of the second and first hearing devices, respectively.

8. A binaural hearing system according to claim 4 configured to apply a psycho-acoustic algorithm to a signal originating from the first or second sound source to make the presented signals appear to the user as if the first and second target sound sources were placed farther away from or closer to each other than they actually are.

9. A binaural hearing system according to claim 1 comprising a user interface allowing a user to control functionality of the beamformer unit.

10. A binaural hearing system according to claim 1 comprising an environment classification unit for classifying the current acoustic environment.

11. A binaural hearing system according to claim 1 comprising a source localization unit for localizing one or more sound sources in the acoustic environment.

12. A binaural hearing system according to claim 1 wherein the at least one of the first and second hearing devices is configured to receive from an auxiliary device a location information related to a direction to and/or location of the first and/or second target sound source relative to the at least one of the first and second hearing devices.

13. A binaural hearing system according to claim 1 wherein the first and second hearing devices comprises a hearing aid, a headset, an earphone, an ear protection device or a combination thereof.

14. A binaural hearing system according to claim 1 wherein the first and second hearing devices each comprise a source localization unit for localizing one or more sound sources in the acoustic environment.

15. A binaural hearing system according to claim 14 wherein the first and second hearing devices are configured to identify said first and second sound sources.

16. A binaural hearing system according to claim 1 wherein the first and second hearing devices are configured to transmit location information to the opposite hearing device.

17. A binaural hearing system according to claim 16 wherein the first and second hearing devices are configured to enter the specific directional mode of operation, where the first and second hearing devices focus their respective beamformer units on the first and second sound sources, respectively, based on said location information from the first and second hearing devices.

18. A binaural hearing system according to claim 1 wherein each of the first and second hearing devices is or comprises a hearing aid.

19. A method of operating a binaural hearing system, the binaural hearing system comprising first and second hearing devices adapted for being mounted at or in left and right ears or fully or partially implanted in the head of a user, the method comprising providing first and second electric input signals representing first and second sound signals from the environment of the binaural hearing system, generating a beamformed signal from the first and second electric input signals, and controlling the beamformed signal, generating or receiving and presenting stimuli perceivable to the user as sound, wherein, in a specific directional mode of operation for listening situation comprising different target sound sources, the first hearing device is controlled to obtain location information of a first target sound source, the beamformed signal of the first hearing device is controlled based on the location information of the first target sound source to focus on the first target sound source, the second hearing device is controlled to obtain location information of a second target sound source different from the first target sound source, the beamformed signal of the second hearing device is controlled based on the location information of the second target sound source to focus on the second target sound source while the beamformed signal of the first hearing device is focused on the first target sound source, a signal originating from the first target sound source is presented by the first hearing device as output, and a signal originating from the second target sound source is presented by the second hearing device as output.

20. A method according to claim 19 wherein each of the first and second hearing devices includes a source localization unit for localizing one or more sound sources in the acoustic environment around the hearing device.

21. A method according to claim 19 further comprising receiving, by at least one of the first and second hearing devices, from an auxiliary device a location information related to a direction to and/or location of the first and/or second target sound source relative to the hearing device.

* * * * *